United States Patent [19]

Verschure

[11] 4,090,367

[45] May 23, 1978

[54] OFFSHORE DRILLING PLATFORM WITH VERTICALLY MOVABLE LEGS

[76] Inventor: Pietrus J. M. Verschure, 17 Prinses Marykestraat, Amsterdam, Netherlands

[21] Appl. No.: 674,735

[22] Filed: Apr. 6, 1976

[51] Int. Cl.[2] ..... E02B 17/08

[52] U.S. Cl. ..... 61/91; 61/90; 254/96; 254/106

[58] Field of Search ..... 61/91, 90, 86; 254/95, 254/96, 97, 105, 106, 107, 111, 112

[56] References Cited

U.S. PATENT DOCUMENTS

| | | | |
|---|---|---|---|
| 2,992,812 | 7/1961 | Rasmussen et al. | 254/107 |
| 3,011,467 | 12/1961 | LeTourneau | 61/91 X |
| 3,290,007 | 12/1966 | Yeilding | 254/106 |
| 3,392,534 | 7/1968 | Blenkarn | 61/90 |
| 3,570,032 | 3/1971 | Allen | 61/90 X |
| 3,967,457 | 7/1976 | Lovie | 61/91 |
| 3,986,368 | 10/1976 | Levingston | 61/91 |

FOREIGN PATENT DOCUMENTS

| | | | |
|---|---|---|---|
| 846,851 | 8/1960 | United Kingdom | 254/107 |

*Primary Examiner*—Dennis L. Taylor
*Attorney, Agent, or Firm*—Young & Thompson

[57] ABSTRACT

An offshore drilling platform with vertically movable legs comprises a buoyant body and a plurality of legs for supporting the body on the sea floor at an elevation above the water level. To permit floating the body for transportation, the legs are selectively vertically movable relative to the body; and in the present invention, this is effected by providing vertical racks on the legs that engage with power-driven pinions carried by the body. The pinion drive has two free-wheel devices, one which free wheels in one direction, and the other which free wheels in the other direction. Each free wheel is clutch connected to the pinion drive, so that when the legs are at an intermediate stage of being raised or lowered, and the platform is at about water level and the bottoms of the legs engage the sea floor, the appropriate free wheel is utilized to let the wave action speed the movement of the legs and platform relative to each other in the same direction that they are being more slowly driven by the pinion drive. In this way, the pounding of the bottoms of the legs on the sea floor is greatly diminished. Also, a system of slides and resilient connections between the legs and the platform absorbs the shocks and reduces the stresses between these elements.

5 Claims, 5 Drawing Figures

OFFSHORE DRILLING PLATFORM WITH VERTICALLY MOVABLE LEGS

The present invention relates to mobile offshore drilling platforms, particularly the type comprising a buoyant platform or body and a plurality of legs that are vertically movable relative to the body, between a raised position of the legs in which the floating body can be towed from place-to-place, and a lowered position of the legs in which the legs rest on the sea floor and support the platform at a distance above the water level.

It is known that when such a platform is put in place or is removed from its location, and the sea is rough, strong shocks are suffered by the structure which act on the elevation mechanism during raising or lowering the legs, when the legs strike the bottom of the sea, the platform being then raised and lowered by the waves at a speed which is many times the speed of relative movement between the platform and the legs. Thus, during this transition period between the fully floating and fully emplaced conditions of the platform, when the lower ends of the legs are at about the level of the sea floor and the platform is at about the water level, the platform and leg assembly is raised and dropped on the sea bottom repeatedly by wave action.

It is an object of the present invention to provide apparatus such that these shocks are reduced in intensity and that their number is considerably decreased. To this end, rack and pinion structure is provided for effecting relative vertical movement between the platform and legs, the pinions being connected to a vertical beam mounted in the platform, which beam is connected at its upper and lower ends with the platform structure through elastic elements which may be blocks of rubber or elastomer, or even springs, this beam being guided in a vertical direction relative to the platform structure by easily detachable slideways which permit, after unlocking the beam from the platform structure, to remove as a unit the vertical beam and pinions and the control mechanism of the pinions, so that once the legs and platforms are in the desired position relative to each other, the operating mechanism can be removed and used in connection with another platform.

The elastic elements situated at the top and bottom of each beam which carries the pinions and their control mechanisms, absorb the shocks each time the bottoms of the legs abruptly contact the sea floor. To reduce hammering on the sea bottom from the legs, under wave action when the platform is being raised or lowered, each drive pinion has control mechanism comprising two clutches or couplings each characterized by a free wheel in the form of a one-way clutch, the free wheel of one coupling permitting the leg to descend freely relative to the platform but preventing the platform from descending relative to the leg; while the free wheel of the other coupling permits the reverse, that is, permits the platform to descend freely relative to the leg but not the leg to descend freely relative to the platform.

The clutches and free wheels referred to above are disposed in the drive train of the pinions, at a point where the relative speeds of the parts caused by the relative movement of a leg and the platform under wave action, occasion in the free wheel assemblies a speed of rotation which is mechanically acceptable.

When the platform is towed toward a site for emplacement, and also when the legs are a substantial distance above the sea floor, the two free wheel clutches are engaged, so that as a security measure the mechanisms are locked in a positive fashion.

When the platform has arrived at the new site, whose water depth is exactly known, the mechanism is driven in a direction to move the platform up relative to the legs. The legs descend slowly under positive drive toward the bottom of the sea; but as soon as the legs contact the bottom of the sea, then that clutch is disengaged which is not in positive drive relation to its free wheel, and a relatively rapid upward movement of the platform relative to the legs can take place under wave action, which is permitted by the free wheel of the engaged clutch. When the sea falls again by wave action, the free wheel of the engaged clutch prevents the platform from falling relative to the legs, the positive drive thereafter continuing its slow raising of the platform. The clutch that was temporarily disengaged can be reengaged, whereby rapid relative movements in either direction are prevented.

On the other hand, when the platform is to be raised and floated to leave the drilling site, the drive mechanism is driven in reverse so as slowly to lower the platform toward the level of the sea. When the platform floats, it will rise and fall with the wave action, and the other clutch is then temporarily disengaged, so that its associated free wheel no longer prevents a rapid rise of the legs relative to the platform. The platform then rapidly falls under wave action; but now, when the platform rises again under wave action, it carries with it the legs, thanks to the free wheel of the clutch that remains engaged. The slow raising of the legs relative to the platform thereafter continues, and the temporarily disengaged clutch is reengaged.

As soon as the legs have been sufficiently raised, the mechanism is stopped and if desired a positive lock can be applied in addition to the lock provided by the drive train, and the platform is towed toward another site.

These and other features, objects and advantages of the present invention will become apparent from a consideration of the following description, taken in connection with the accompanying drawings, in which.

Figure 1:
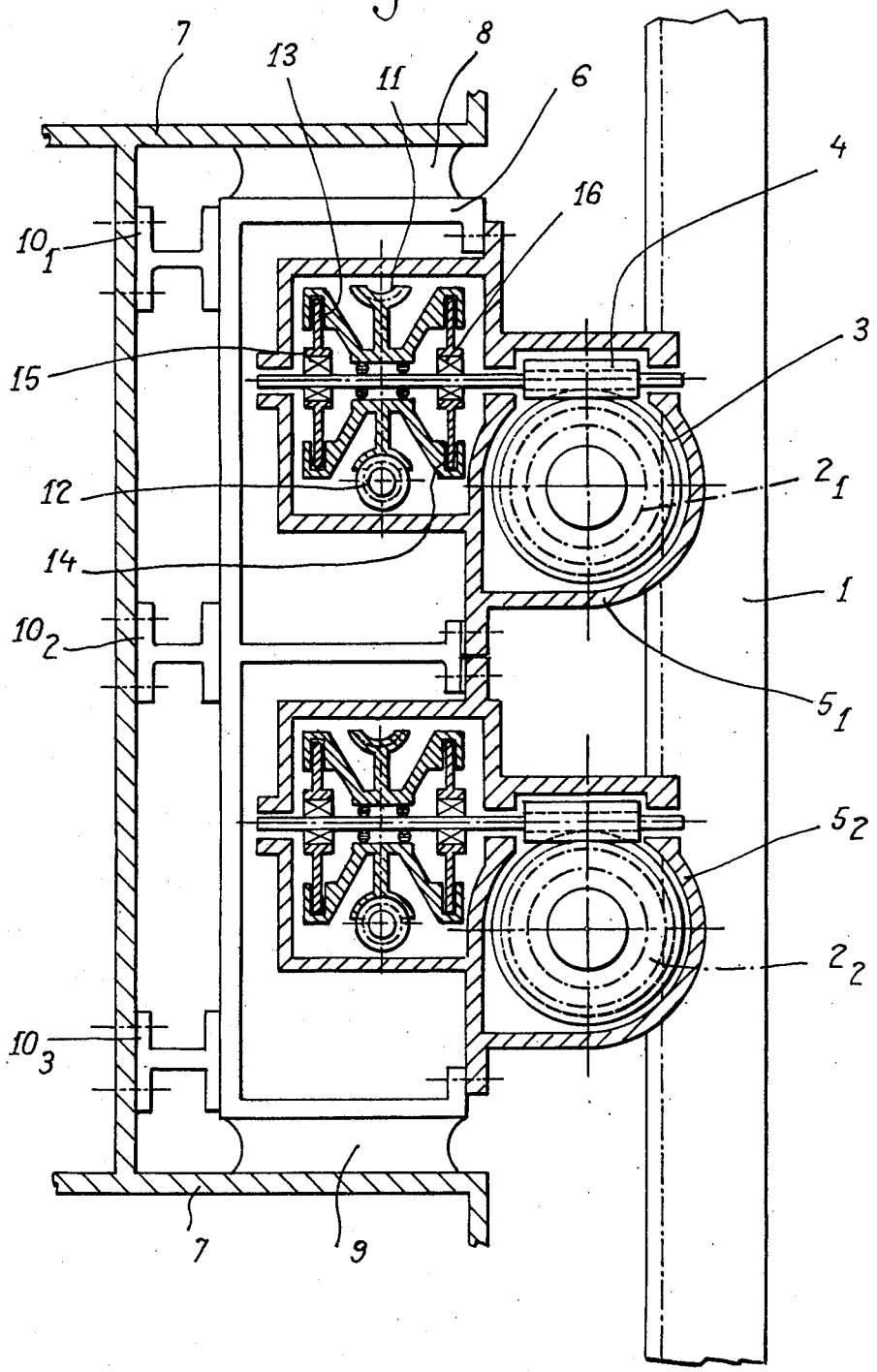
FIG. 1 is a side elevational view, partly in section, of apparatus according to the present invention in the vicinity of the rack and pinion connection between a platform and one vertical element of a leg.

Referring now to the drawings in greater detail, and first to the embodiment of FIG. 1, there is shown a drilling platform according to the present invention having a plurality of legs each of which is characterized by three interconnected vertical cast steel tubes arranged, as seen in a horizontal plane, in a triangular configuration interconnected by crosspieces, in a conventional manner. One of these tubes is shown in FIG. 1, in the form of a rack 1 which is provided with vertically spaced teeth integrally cast therein. Two vertically spaced drive pinions $\mathbf{2}_1$ and $\mathbf{2}_2$ engage with these teeth, these pinions being driven by tangential gear wheels 3 which are driven in turn by endless worm gears 4 which are selectively driven in either direction of rotation by conventional motor means (not shown). The gear wheels 3 and worms 4 have such a ratio that they are easily reversible in drive direction. Casings $5_1$ and $5_2$ house and provide bearings for the pinions $2_1$ and $2_2$ and the control mechanisms are fixed to a beam 6, which bears on the structure 7 of the platform at the top of beam 6 by an elastic block 8 and at the bottom by an elastic block 9. Slides $10_1$, $10_2$ and $10_3$ also receive bearing thrust between the beam 6 and the structure 7. Vertical shocks between the rack and the pinions are absorbed by the elastic blocks 8 and 9. Also, it is easy to dismount the beam 6 with the pinions and the control mechanisms from the slides and blocks.

The worms 4 are driven by a gear wheel 11 and by an endless worm 12, the gear wheel 11 being connected to the worm 4 by clutches 13 and 14 and free wheels 15 and 16, the free wheels 15 and 16 being reversed relative to each other so that one free wheels in one direction only, and the other free wheels in the other direction only.

Figure 2:
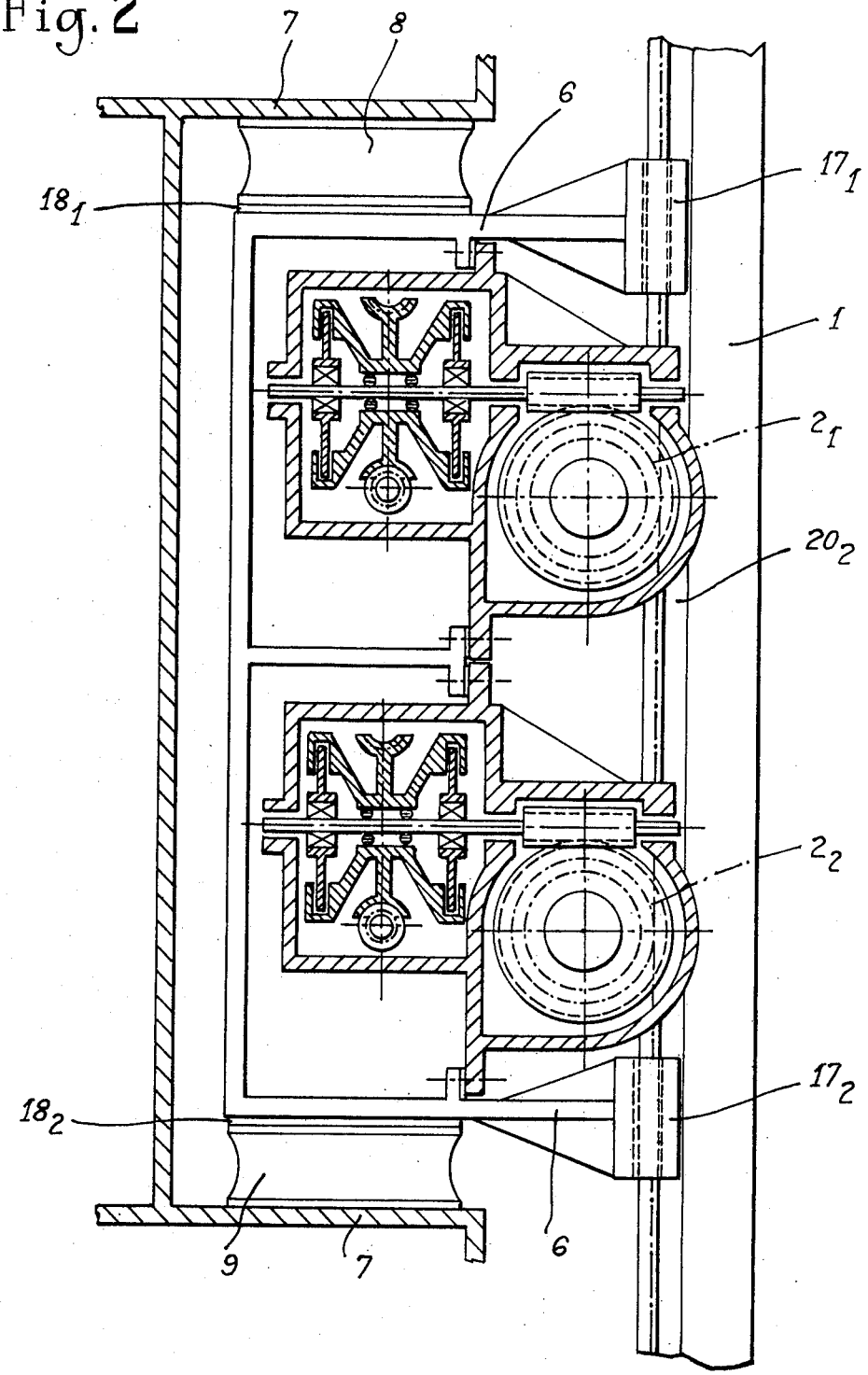
FIG. 2 is a view similar to FIG. 1, but showing a second embodiment of the invention.
Figure 3:
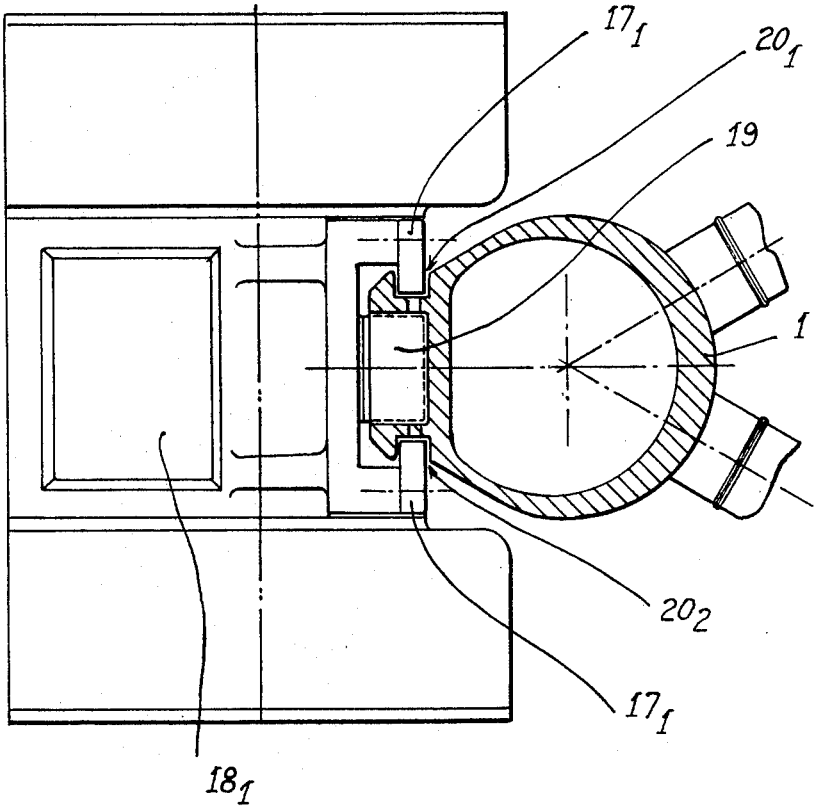
FIG. 3 is a top plan cross-sectional view of the embodiment of FIG. 2.

In the embodiment according to FIGS. 2 and 3, the slides $10_1$ and $10_2$ and $10_3$ which, in the embodiment of FIG. 1 were interposed between the beam 6 and the forward part of chassis 7, are missing, and are replaced by slides $17_1$ and $17_2$ fixed to the beam 6 and bearing on the rack 1, and by slides $18_1$ and $18_2$ which are also fixed to the beam 6 and are interposed between the latter and the elastic blocks 8 and 9. The rack 1, as pointed out above, is of cast steel and comprises vertically spaced teeth 19 with two vertical slideways $20_1$ and $20_2$ on either side of the teeth 19, which serve to guide the slides $17_1$ and $17_2$ as is easily seen in FIG. 3.

Figure 4:
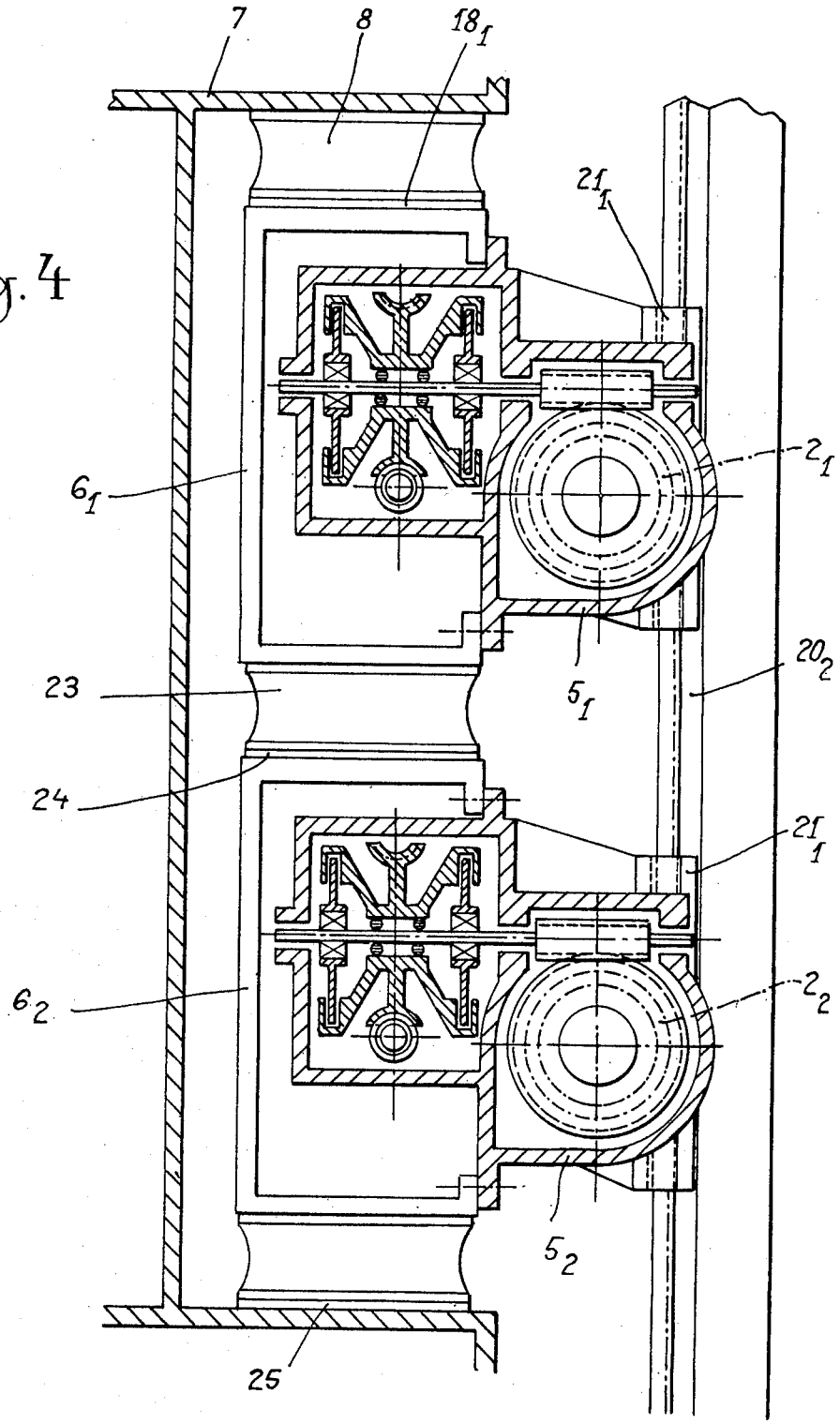
FIGS. 4 and 5 are views similar to FIGS. 2 and 3, respectively, but showing a third embodiment of the invention.
Figure 5:
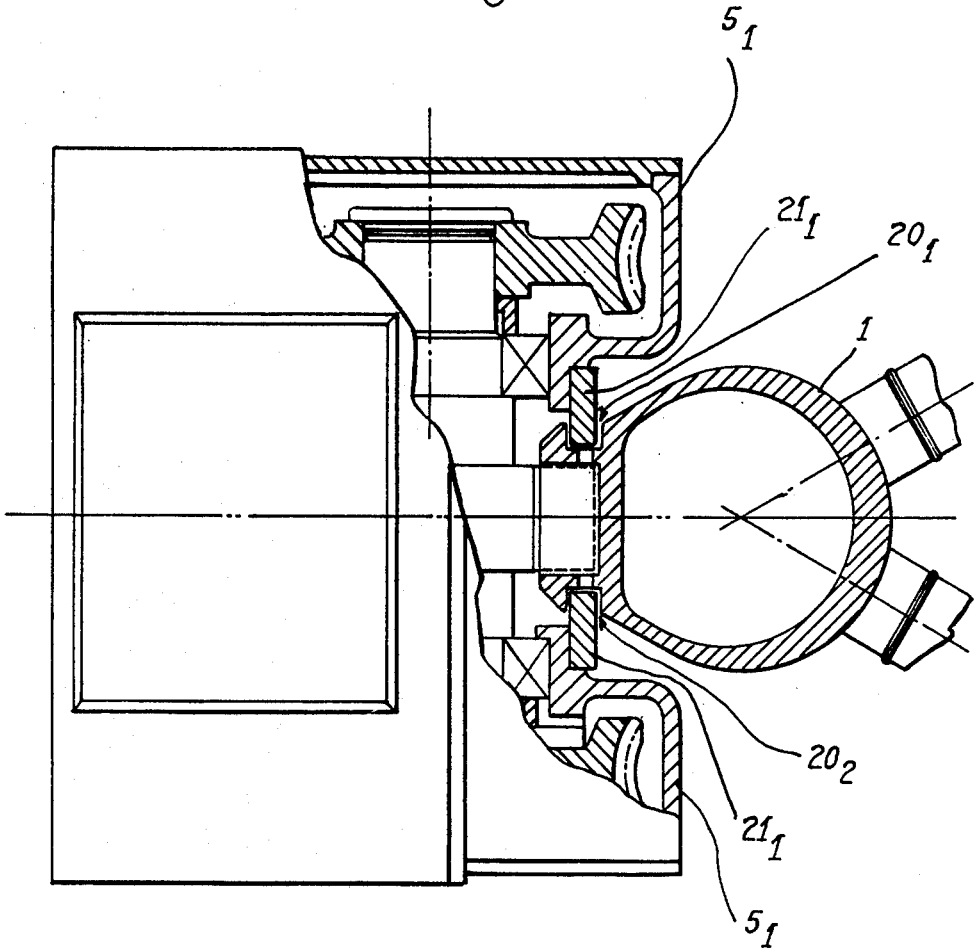

In the embodiment of FIGS. 4 and 5, the beam 6 is divided in as many sections as there are pinions, namely, in the case of the illustrated embodiment, into two sections $6_1$ and $6_2$. The slides $21_1$ and $21_2$ that bear against the rack are carried respectively by the housings $5_1$ and $5_2$ of the pinions, and the slides $18_1$ and 25, associated respectively with the elastic blocks 8 and 9, are fixed respectively to the sections $6_1$ and $6_2$ and to the chassis 7, while a supplemental elastic block 23 is disposed between the two beam sections $6_1$ and $6_2$ with the interposition of a slide 24 between this block 23 and the section $6_2$.

Thanks to this division of the beam into sections, the demounting of the mechanisms may be effectuated section-by-section, after having disconnected the slides which are guided by the racks.

It should be noted that in the last two embodiments that have been described, the relative movements between the pinions and the rack are considerably reduced. The pinion teeth and the racks may provide a substantial correction of the mesh between the intermeshing elements, such that the friction of the interconnecting elements decreases the force on the slideways during raising of the platform, at which time the mechanisms transmit the maximum force.

It will also be understood that conventional means (not shown) are provided for selectively engaging and disengaging the clutches 13 and 14, as well as conventional means (not shown) for positively locking the platform and legs in an adjusted position relative to each other independently of the drive train.

If it is assumed that the free wheel 15 of the clutch 13 permits free descent of the platform relative to the legs, but prevents the opposite movement, while the free wheel 16 associated with the clutch 14 permits free descent of the legs relative to the platform, but prevents the opposite movement, then it will be appreciated that, when the pinions are driven in a direction slowly to raise the legs relative to the platform, and the platform reaches the water level, the clutch 13 will be engaged and the clutch 14 will be temporarily disengaged, whereby wave action permits the platform to descend much more rapidly relative to the legs than is effected by the positive drive of the rack and pinion. On the other hand, when the platform is being emplaced and the positive rack and pinion drive rotates in the opposite direction to raise the platform relative to the legs, then when the legs reach the sea floor the clutch 13 is temporarily disengaged and the clutch 14 remains engaged, so that wave action can rapidly raise the platform relative to the legs thanks to the free wheel 16, which, however, catches the platform and keeps it raised, because free wheel 16, like free wheel 15, is a one-way clutch. In other words, by virtue of the action of the free wheels 15 and 16, which function as oppositely arranged overrunning or one-way clutches, only one of which is engaged during the intermediate phase of lowering the platform and only the other of which is engaged during the intermediate phase of raising the platform, use is made of the wave action for rapidly moving the platform and legs relative to each other in the same direction that the rack and pinion slowly drives them, thereby greatly to reduce the time during which the assembly is subject to the undesirable and potentially destructive shocks that arise from the legs hammering on the sea floor. At the same time, it will of course be recognized that such few shocks as are nevertheless encountered, are well absorbed by the elastic and sliding constructions described above.

From a consideration of the foregoing disclosure, therefore, it will be evident that the initially recited objects of the present invention have been achieved.

Although the present invention has been described and illustrated in connection with particular embodiments, it is to be understood that modifications and variations may be resorted to without departing from the spirit of the invention, as those skilled in this art will readily understand. Thus, the number of pinions associated with each beam is variable, and the drive train for each pinion may include planetary gearing in addition to or in place of the endless screws shown in the drawings. The free wheels 15 and 16 may have the form of ratchet wheels or any other conventional free wheel mechanism; while the clutches 13 and 14 may be single disc clutches, multiple disc clutches, tooth clutches, claw clutches or the like; and the control of the clutches may be electrical, pneumatic or hydraulic, according to any of the many well known such constructions in this art.

These and other modifications and variations are considered to be within the purview and scope of the present invention as defined by the appended claims.

What is claimed is:

1. An offshore drilling platform having a plurality of legs that support the platform, each of said legs having a rack thereon comprised by a plurality of vertically spaced teeth, drive pinions carried by the platform, each said pinion engaging the teeth of a said rack, and means to drive each said pinion selectively in opposite directions, said drive means including a pair of free wheels one of which permits free relative movement between the platform and legs in only one vertical direction and the other of which permits free relative movement of the platform and legs in only the other vertical direction, and means for selectively engaging each of said free wheels in a drive train to each of said pinions whereby when the bottoms of the legs are adjacent the sea floor and the platform is adjacent the water level, one of said selective engaging means can be engaged and the other disengaged to utilize wave action of the sea to move the platform and legs relative to each other in the same direction that the pinions drive the platform and legs relative to each other, thereby to reduce the time when the lower ends of the legs can hammer on the sea bottom under said wave action.

2. An offshore drilling platform having a plurality of legs that support the platform, each of said legs having a rack thereon comprised by a plurality of vertically spaced teeth, beams carried by the platform, elastic members and slideways disposed between the beams and the platform, drive pinions carried by the beams, each said pinion engaging the teeth of a said rack, means to drive each said pinion, each said beam being divided into a plurality of sections each having a said pinion thereon, said sections being spaced from each other and from horizontal surfaces of the platform, said elastic elements being disposed between said sections and also between said sections and said horizontal surfaces of the platform.

3. A platform as claimed in claim 2, some of said slideways being disposed between said elastic elements and said beam.

4. A platform as claimed in claim 2, said slideways being disposed between said elastic members on the one hand and said sections and said platform on the other hand.

5. A platform as claimed in claim 2, said slideways being disposed in horizontal planes.

* * * * *